US007137369B2

(12) United States Patent
Jiang

(10) Patent No.: US 7,137,369 B2
(45) Date of Patent: Nov. 21, 2006

(54) VCT CLOSED-LOOP CONTROL USING A TWO-POSITION ON/OFF SOLENOID

(75) Inventor: Zhenyu Jiang, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 271 days.

(21) Appl. No.: 10/934,176

(22) Filed: Sep. 3, 2004

(65) Prior Publication Data

US 2005/0241602 A1 Nov. 3, 2005

Related U.S. Application Data

(60) Provisional application No. 60/566,218, filed on Apr. 28, 2004.

(51) Int. Cl.
*F01L 1/34* (2006.01)

(52) U.S. Cl. ..... 123/90.16; 123/90.17; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 5,184,578 | A | 2/1993 | Quinn, Jr. et al. | 123/90.17 |
| 5,289,805 | A | 3/1994 | Quinn, Jr. et al. | 123/90.17 |
| 6,263,846 | B1 | 7/2001 | Simpson et al. | 123/90.17 |
| 6,666,181 | B1 | 12/2003 | Smith et al. | 123/90.17 |
| 6,668,778 | B1 | 12/2003 | Smith | 123/90.17 |
| 6,938,592 | B1 * | 9/2005 | Taylor et al. | 123/90.15 |
| 2003/0192518 | A1 | 10/2003 | Gopp et al. | 123/568.21 |
| 2003/0196624 | A1 | 10/2003 | Smith | 123/90.17 |
| 2003/0196625 | A1 | 10/2003 | Smith | 123/90.17 |
| 2003/0196626 | A1 | 10/2003 | Smith et al. | 123/90.17 |
| 2003/0230262 | A1 | 12/2003 | Quinn, Jr. | 123/90.15 |
| 2003/0230263 | A1 | 12/2003 | Ekdahl et al. | 123/90.15 |
| 2003/0230266 | A1 | 12/2003 | Ekdahl et al. | 123/90.15 |
| 2004/0003788 | A1 | 1/2004 | Taylor et al. | 123/90.15 |
| 2004/0040525 | A1 | 3/2004 | Simpson | 123/90.17 |

FOREIGN PATENT DOCUMENTS

| | | | |
|---|---|---|---|
| EP | 1375838 | A2 | 1/2004 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

In a VCT system having a feedback loop including a sensed signal and a set point, a method is provided, which includes the steps of: determining a switch variable which is related to the sensed signal and the set point; computing the switch variable; and according to the value of the switch variable, controlling the operation of an on/off two position solenoid that controls the flow of a control fluid flowing within a VCT phaser. Thereby the control fluid either flows in one direction or another direction by means of using a two-position ON/OFF solenoid for actuating a spool valve which controls the flow direction with the VCT phaser.

6 Claims, 4 Drawing Sheets

VCT CLOSED-LOOP CONTROL USING A TWO-POSITION ON/OFF SOLENOID

REFERENCE TO PROVISIONAL APPLICATION

This application claims an invention which was disclosed in Provisional Application No. 60/566,218, filed Apr. 28, 2004, entitled "VCT CLOSED-LOOP CONTROL USING A TWO-POSITION ON/OFF SOLENOID". The benefit under 35 USC §119(e) of the United States provisional application is hereby claimed, and the aforementioned application is hereby incorporated herein by reference.

FIELD OF THE INVENTION

The invention pertains to the field of closed loop control systems. More particularly, the invention pertains to VCT closed loop control using a 2-position on/off solenoid.

BACKGROUND OF THE INVENTION

U.S. published patent application No. 20030230266A1 entitled VCT SOLENOID DITHER FREQUENCY CONTROL by Ekdahl, Earl et al discloses a method that uses a dither signal for reducing hysteresis effect in a variable cam timing system is provided. The method includes the steps of: a) providing a dither signal having at least two switchable frequencies; b) determining the frequency characteristics of an engine speed; c) determining at least one frequency beating point in relation to a neighborhood of an engine crank RPM values; and d) changing the dither signal frequency when the engine is operating within the neighborhood of the engine crank RPM values. Thereby frequency beating effect is reduced.

U.S. published patent application No. 20040003788A1 entitled CONTROL METHOD FOR ELECTRO-HYDRAULIC CONTROL VALVES OVER TEMPERATURE RANGE by Taylor, Danny et al discloses a variable cam timing (VCT) system which has a feedback control loop wherein an error signal relating to at least one sensed position signal of either a crank shaft position or at least one cam shaft position is fed back for correcting a predetermined command signal. The system further includes a valve for controlling a relative angular relationship of a phaser; and includes a variable force solenoid for controlling a translational movement of the valve. An improved control method comprising the steps of: providing a dither signal sufficiently smaller than the error signal; as temperature varies, changing at least one parameter relating to the dither signal; and applying the dither signal upon the variable force solenoid, thereby using the dither signal for overcoming a system hysteresis without causing excessive movement of valve.

European Patent No. 1375838A2 entitled CONTROL METHOD FOR TRANSITIONS BETWEEN OPEN AND CLOSED LOOP OPERATION IN ELECTRONIC VCT CONTROL by Quinn, Jr., Stanley B et al discloses a Variable Cam Timing (VCT) control system, there are conditions when the system must operate in an open-loop mode, and other situations where closed-loop operation is desired. A number of operating states is provided for VCT control system to switch between the states. A control methodology for switching between these two modes of operation, with minimal disturbances, is described. Further, during switching from open loop to closed loop, a scheme that impedes the impact upon the VCT system is provided.

U.S. published patent application No. 20040040525A1 entitled Method to reduce noise of a cam phaser by controlling the position of center mounted spool valve by Simpson, Roger discloses a method to reduce the noise caused by torsional reversals of a rotor hitting the phaser housing in a VCT cam timing system. A cam torque actuated phaser (phaser with check valves) the control loop is opened and rather then moving the spool valve to one end or the other end, the spool valve is moved just slightly off null. By doing this the oil ports in the spool passageways that control the motion of the phaser are restricted and the motion of the phaser is reduced. Therefore the noise of the phaser is reduced.

U.S. published patent application No. 20030230263A1 entitled VCT cam timing system utilizing calculation of intake phase for dual dependent cams by Ekdahl, Earl et al discloses an engine with dependent intake cams requires a different method and formula to determine the phase of the intake cams. The exhaust camshaft drives the intake camshaft and so the intake cam position is dependent upon the exhaust cam position. The present invention provides a VCT cam timing system utilizing calculation of intake phase for dual dependent cams.

U.S. Pat. No. 6,666,181 entitled Hydraulic detent for a variable camshaft timing device by Smith, Franklin R.; et al discloses a phaser which includes a housing and a rotor disposed to rotate relative to each other is provided. The housing has at least one cavity disposed to be divided by a vane rigidly attached to the rotor. The vane divides the cavity into a first chamber and a second chamber. The phaser further includes passages connecting the first and the second chamber, thereby facilitating the oscillation of the vane within the cavity. The phaser includes: a) a valve disposed to form at least two openings for fluid flowing between the first chamber and the second chamber and being disposed to keep at least one opening closed; and b) at least one by-pass disposed to stop or slow down the rotation between the housing and the rotor, thereby allowing a locking mechanism to lock the housing and the rotor together independent of fluid flow.

U.S. published patent application No. 20030230262A1 entitled Control method for achieving expected VCT actuation rate using set point rate limiter by Quinn, Jr., Stanley B teaches in a VCT system having a feedback loop for controlling a phaser angular relationship, a control law disposed to receive a plurality of set point values and a plurality of feed back values is provided to include: a computation block for receiving the plurality of set point values as inputs, the computation block outputting a first output and a second output; a first summer for summing the first output and the plurality of feed back values to produce a first sum ($e_0$); a phase integrator and a phase compensator receiving the first sum ($e_0$) and derivatives ($e_1$) thereof outputting a processed value ($e_2$); a amplifier amplifying the second output by a predetermined scale ($K_{ff}$); and e) a second summer for summing the processed value ($e_2$) and the amplified second output to produce a second sum ($e_3$).

U.S. Pat. No. 6,668,778 entitled Using differential pressure control system for VCT lock by Smith, Franklin R. discloses a variable cam timing system comprising a VCT locking pin in hydraulic communication with the control circuit of the differential pressure control system (DPCS) is provided. When the control pressure is less than 50% duty cycle the same control signal commands the locking pin to engage and the VCT to move toward the mechanical stop. When the control pressure is greater than 50% duty cycle the locking pin disengages and the VCT moves away from the mechanical stop.

U.S. Pat. No. 6,263,846 entitled Control valve strategy for vane-type variable camshaft timing system by Simpson, Roger et al discloses an internal combustion engine includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes (to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. published patent application No. 20030196625A1 entitled Air venting mechanism for variable camshaft timing devices by Smith, Franklin R.; discloses a device includes: a locking member substantially disposed within a closure in the housing, the locking member locking the housing and the rotor free from relative rotation and independent of fluid flow; and at least one vent passage disposed between either the first or the second chamber and the closure in the housing; thereby air within the chamber is purged and noise stopped.

Furthermore, U.S. published patent application No. 20030192518A1 entitled SYSTEM AND METHOD FOR EXHAUST GAS RECIRCULATION CONTROL by Gopp, Alexander Yuri et al discloses a system and method for controlling a multi-cylinder internal combustion engine having at least one automatically controllable airflow actuator and an exhaust gas recirculation (EGR) system including an EGR valve include determining a desired manifold pressure based at least in part on position of the automatically controllable airflow actuator and controlling the EGR valve such that a measured manifold pressure approaches the desired manifold pressure. In one embodiment, the automatically controllable airflow actuators include a charge motion control valve and a variable cam timing device. In other embodiments, the automatically controllable airflow actuators may include variable valve lift devices, variable valve timing devices, or any other device that affects the residual exhaust gases within the cylinders.

However, no prior art patents or publications using on/off solenoid use a predefined entity having a level being preset is disclosed or taught. Therefore, it is desirous to have an on/off solenoid in a feedback control loop, wherein a switching variable is provided, and a calculation based on the sign of the switch's numerical value is also provided for turning on or off the two-position ON/OFF solenoid.

SUMMARY OF THE INVENTION

In a VCT system, having a feedback loop, where an ON/OFF solenoid is provided such that the solenoid is used for actuating a spool valve which controls the flow direction associated with a VCT phaser.

In a VCT system, having a feedback loop, wherein a two-position ON/OFF solenoid is provided such that the solenoid is used for actuating a spool valve which controls the flow direction associated with a VCT phaser.

In a VCT system, having a feedback loop with an ON/OFF solenoid a switching variable, i.e. switch, is provided, and a calculation based on the sign of the switch's numerical value is also provided for turning on or off the two-position ON/OFF solenoid.

A small size and fast response two-position ON/OFF solenoid is provided for pushing a spool valve which controls the flow direction within a VCT phaser.

A switching variable, i.e. switch is provided, wherein the switch is calculated within a control law. And based on the sign of the numerical value of switch, the two-position ON/OFF valve is turned on or off.

Accordingly, in a VCT system having a feedback loop including a sensed signal and a set point, a method is provided, which includes the steps of: determining a switch variable which is related to the sensed signal and the set point; computing the switch variable; and according to the value of the switch variable, controlling the operation of an on/off two position solenoid that controls the flow of a control fluid flowing within a VCT phaser. Thereby the control fluid either flows in one direction or another direction within the VCT phaser by means of using a two-position ON/OFF solenoid for actuating a spool valve which controls the flow direction with the VCT phaser.

Accordingly, A VCT system is provided which comprises: a feedback loop including a sensed signal and a set point; a two-position ON/OFF solenoid for actuating a spool valve which controls the flow direction with a VCT phaser. The system further comprises a method including the steps of: determining a switch variable which is related to the sensed signal and the set point; computing the switch variable; and according to the value of the switch variable, controlling the operation of the on/off two position solenoid that controls the flow of a control fluid flowing within the VCT phaser, thereby the control fluid either flows in one direction or another direction within the VCT phaser by means of using a two-position ON/OFF solenoid for actuating a spool valve which controls the flow direction with the VCT phaser

DESCRIPTION OF THE PREFERRED EMBODIMENT

This section includes the descriptions of the present invention including the preferred embodiment of the present invention for the understanding of the same. It is noted that the embodiments are merely describing the invention. The claims section of the present invention defines the boundaries of the property right conferred by law.

U.S. Pat. No. 5,289,805, which is hereby incorporated herein by reference, entitled: Self-Calibrating Variable Camshaft Timing System, discloses a closed-loop actuator is a variable force solenoid (VFS). The system in U.S. Pat. No. 5,289,805 patent may be depicted as a feedback loop as shown in FIG. 1.

Figure 1:
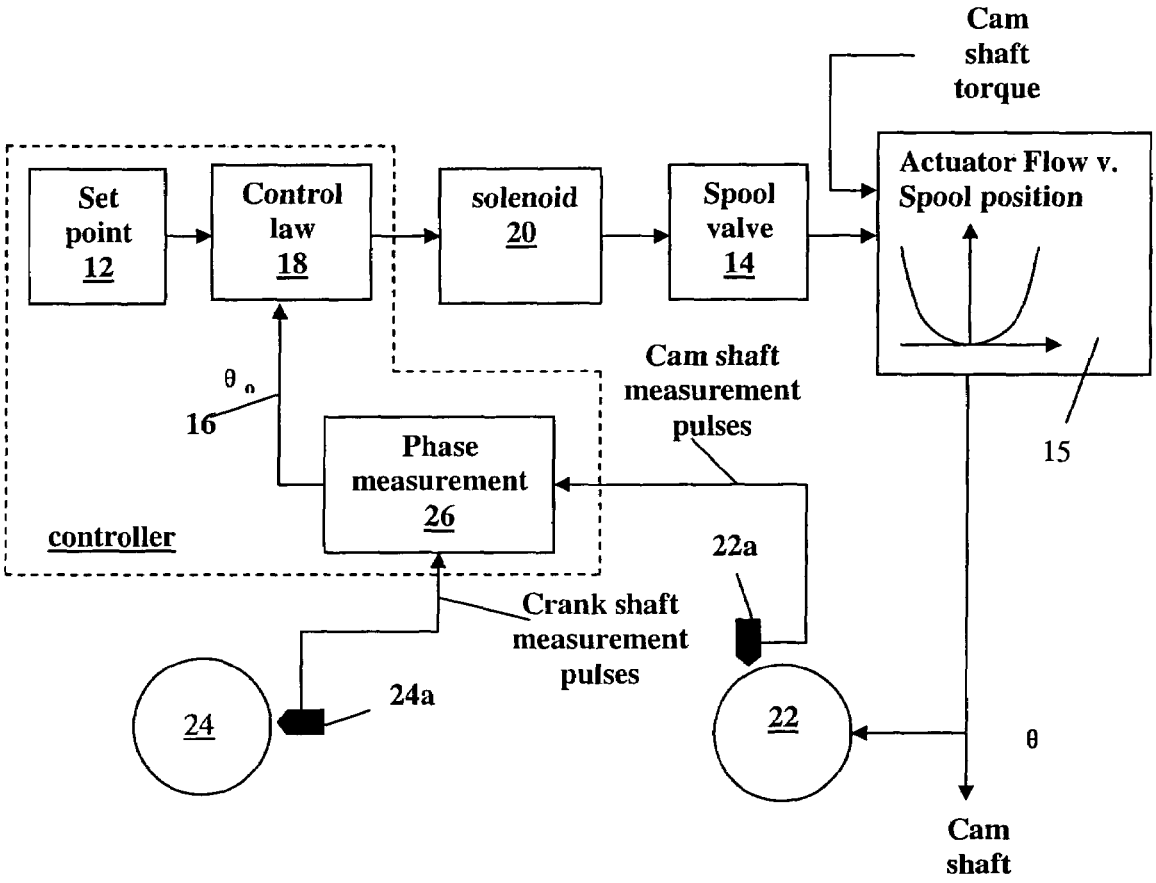
FIG. 1 shows a prior art VCT loop.

Referring to FIG. 1, a prior art feedback loop 10 is shown. The control objective of feedback loop 10 is to have a spool valve in a null position. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at the correct phase position and the phase rate of change is zero. A control computer program product which utilizes the dynamic state of the VCT mechanism is used to accomplish the above state.

The VCT closed-loop control mechanism is achieved by measuring a camshaft phase shift $\theta_0$ 16, and comparing the same to the desired set point 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point r 12 and phase shift 16) is non-zero.

The spool 14 is moved toward a first direction (e.g. right) if the phase error is negative (retard) and to a second direction (e.g. left) if the phase error is positive (advance). It is noted that the retarding with current phase measurement scheme gives a larger value, and advancing yields a small value. When the phase error is zero, the VCT phase equals the set point 12 so the spool 14 is held in the null position such that no fluid flows within the spool valve. Note the functional relationship 15 of control fluid flow status versus spool valve 14 positions.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase between a camshaft and a crankshaft is defined as the time from successive crank-to-cam pulses, divided by the time for an entire revolution and multiplied by 360 degrees. The measured phase may be expressed as $\theta_0$ 16. This phase is then supplied to the control law 18 for reaching the desired spool position.

Solenoid 20 typically is a variable force solenoid (VFS) where the force exerted upon spool 14 varies thereby causing different displacement of spool 14 along a predetermined line thereby causing variable amount of control fluid flow. Typically VFS are bulky in that it has a large footprint, thereby taking valuable space within an engine head or about an engine cover. Therefore, if small size is desirable, the VFS cannot meet the designated dimension restriction.

Figure 1A:
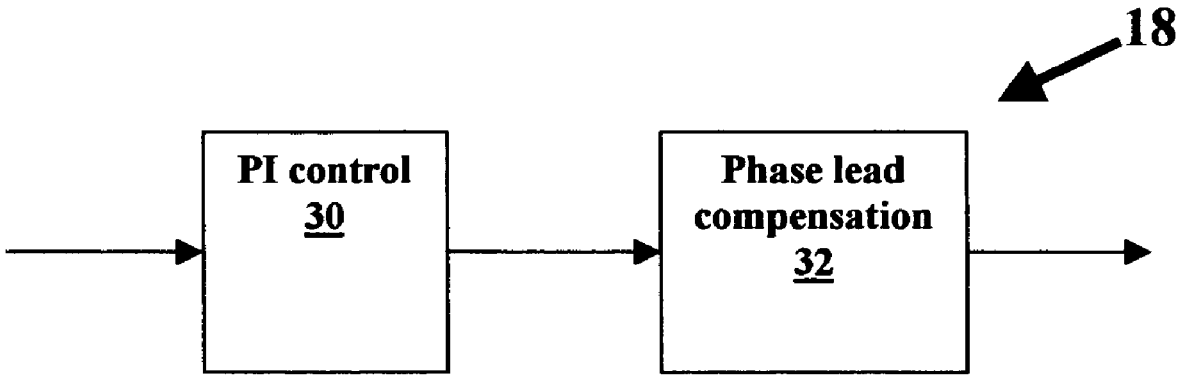
Fig. 1A (Prior Art)
FIG. 1A shows a control law of the prior art VCT loop of FIG. 1.

A control law 18 of the closed-loop 10 is described in U.S. Pat. No. 5,184,578 and is hereby incorporate herein by reference. A simplified depiction of the control law is shown in FIG. 1A. Measured phase 26 is subjected to the control law 18 initially at block 30 wherein a Proportional-Integral (PI) process occurs. PI process is the sum of two sub-processes. The first sub-process includes amplification; and the second sub-process includes integration. Measured phase is further subjected to phase compensation at block 32, where control signal is adjusted to increase the overall control system stability before it is sent out to drive the actuator, in the instant case, a variable force solenoid.

In other words, while a VFS provides a good closed-loop control performance, it also bears several drawbacks such as higher cost, larger package size, and less reliability. This invention avoids the above drawbacks inherited from the VFS by replacing it with a two-position ON/OFF solenoid. A two-position ON/OFF solenoid is much less expensive, smaller size, and more reliable than a VFS.

Figure 2:
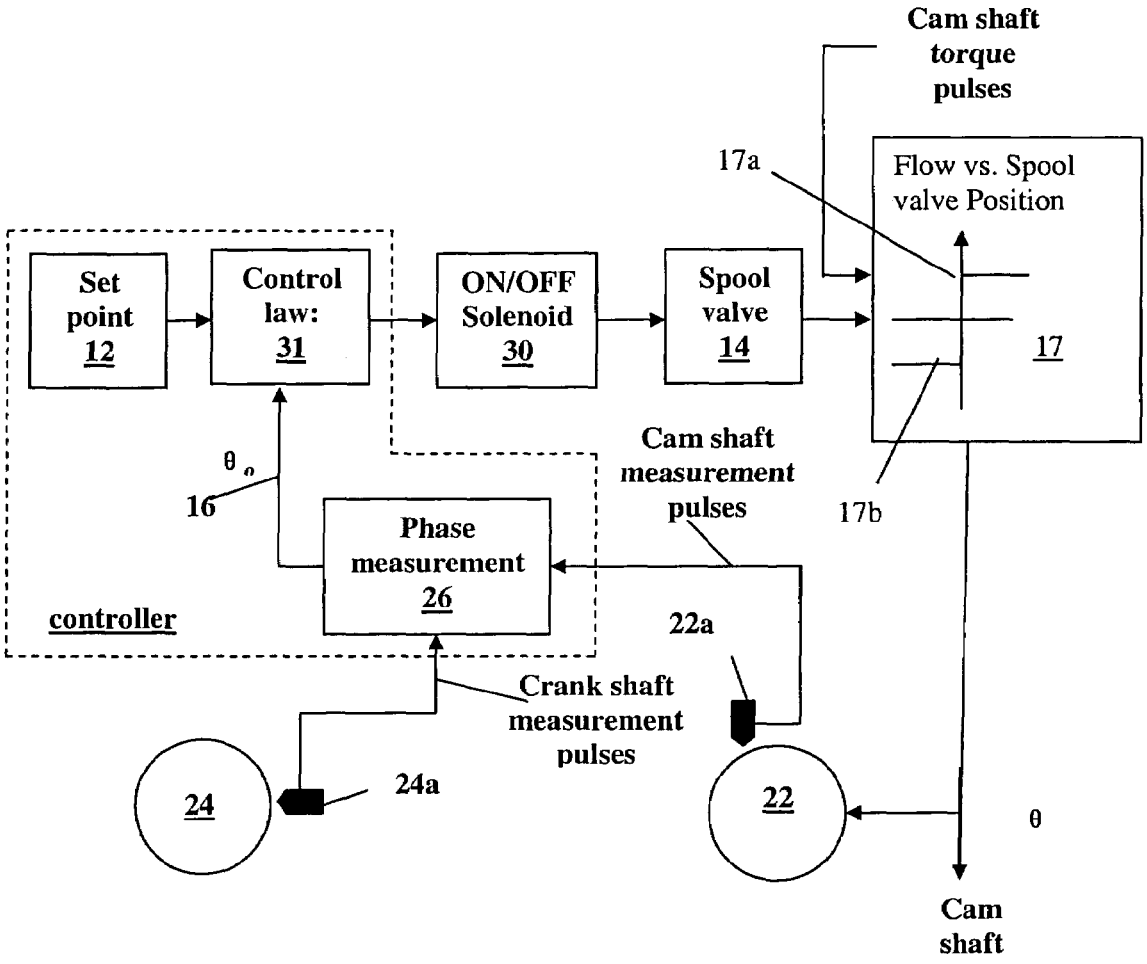
FIG. 2 shows control loop of the present invention.

The present invention provides a small sized and fast responsive two-position ON/OFF solenoid for pushing a spool valve which controls the flow direction within a VCT phaser, as show in FIG. 2

Referring to FIG. 2, feedback loop 11 is shown. The control objective of feedback loop 11 is to have a spool valve in a null position. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at the correct phase position and the phase rate of change is zero. A control computer program product which utilizes the dynamic state of the VCT mechanism is used to accomplish the above state.

The VCT closed-loop control mechanism is achieved by measuring a camshaft phase shift $\theta_0$ 16, and comparing the same to the desired set point 12. The VCT mechanism is in turn adjusted so that the phaser achieves a position which is determined by the set point 12, which is a computed value controller by a controller such as a VCT controller or built in the engine control unit (ECU). A control law 31 compares the set point 12 to the phase shift $\theta_0$ 16 which is associated with at least one measured value such as a sensed crank pulse or cam pulse. The compared result is used as a reference to issue commands to an on/off solenoid 30 to position the spool 14. On/off solenoid 30 may be a two position solenoid. This positioning of spool 14 occurs when the phase error (the difference between set point 12 and phase shift 16) is non-zero.

Note the functional relationship 17 of fluid flow status versus spool valve 14 position, in that only two valve positions, i.e. first position 17*a* and second position 17*b* exit are used due to the on/off nature of the solenoid. In other words, ideally the control fluid either fully flows or is totally such off.

By way of an example, the spool 14 is moved toward a first direction (e.g. right) if the phase error is negative (retard) and to a second direction (e.g. left) if the phase error is positive (advance). It is noted that retarding with the current phase measurement scheme gives a larger value, and advancing yields a small value. When the phase error is zero, the VCT phase equals the set point 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase between a camshaft and a crankshaft is defined as the time from successive crank-to-cam pulses, divided by the time for an entire revolution and multiplied by 360 degrees. The measured phase may be expressed as $\theta_0$ 16. This phase is then supplied to the control law 31 for reaching the desired spool position.

Solenoid 30 of the present invention is a small sized and fast responsive two-position ON/OFF solenoid for pushing spool valve 14 which controls the flow direction within a VCT phaser. A switching variable switch is calculated within control law 31. Based on the value or the sign of the numerical value of switch, the two-position ON/OFF valve is turned on or off. The following are a logical process suitable for computer the values of the switch variable.

Ifsign(switch)>0

Turn on the two-position ON/OFF solenoid, allow the hydraulic fluid within a VCT to flows in one direction.

Ifsign(switch)<0

Turn off the two-position ON/OFF solenoid, allow the hydraulic fluid within a VCT to flow in the opposite direction.

Ifswitch=0

Maintain the original solenoid status

In the present invention, there are various ways of calculating the value of switch. One preferred way of calculating switch is switch=theta_setP−theta_M Another preferred way of calculating switch is $$\text{switch}=C_1*(\text{theta_set}P-\text{theta_}M)+C_2*(\text{theta_}M\text{ Dot})$$

where, theta_setP is VCT position set point; theta_M is measured VCT position;

(theta_M Dot) is the derivative of theta_M;

$C_1$, and $C_2$ are control parameters to be tuned.

It is noted that the rate of change may be such that a first order error correction of $C_2$*(theta_M Dot) may be insufficient. Thereby, higher order error corrections may be necessary. There is potentially a multiplicity of ways to calculate the switch variables. Some variables may perform better than others. The present invention teaches a control command which is calculated based on the sign or at least some threshold of the switch variable.

As can be seen, compared to the prior art VFS which may increase control fluid flow (see 15 of FIG. 1), the on/off solenoid of the present invention maintains only two positions, i.e. either on or off (see numerals 17, 17*a*, and 17*b* of FIG. 2). The control fluid flow is caused by cam shaft torque pulses associated with either a CTA or a TA system. It should be noted that the present invention also contemplates its use in an OPA system.

Figure 3:
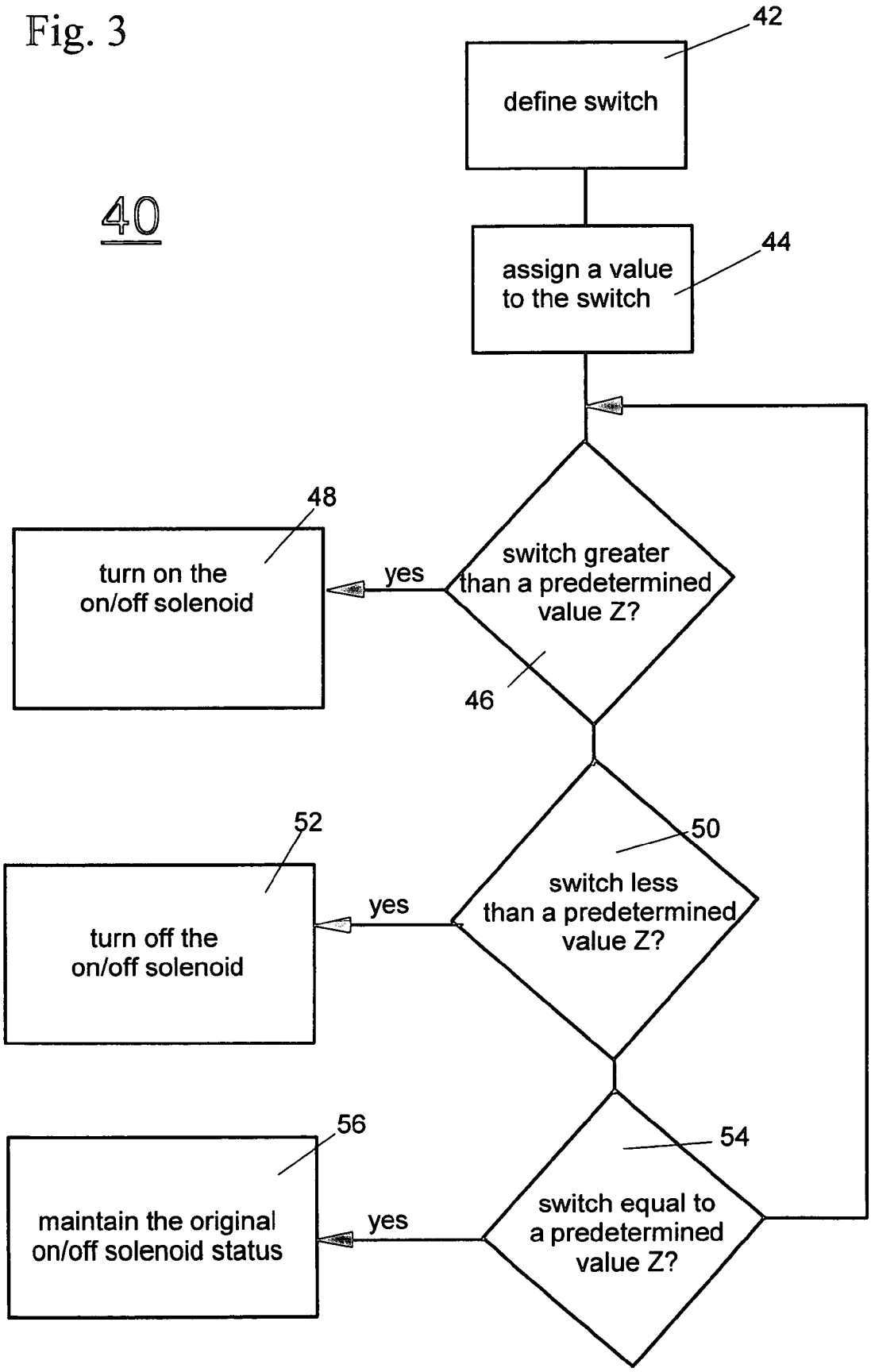
FIG. 3 shows a flow chart of the present invention.

Referring to FIG. 3, a flowchart 40 is shown. A switching variable switch is defined as 42, and a value assigned to the same 44. The switching variable Switch is calculated for example within control law 31 of FIG. 2. A first determination 46 is performed in that if the value of the switch is greater than a predetermined value Z, the on/off solenoid is turned on 48. A second determination 50 is in turn performed in that if the value of the switch is less than the predetermined value Z, the on/off solenoid is turned on 48. A third determination 54 is in turn performed in that if the value of the switch is equal to the predetermined value Z, the on/off solenoid maintains its original on/off solenoid status The predetermined value Z can be of any value including the value zero.

As can be seen, the present invention includes the use of a two-position ON/OFF solenoid to actuate a spool valve which controls the flow direction with a VCT phaser. A switch variable is provided and based on the determined value of the switch variable, the on/off solenoid is either turn on, or switched off, or maintains its current state, which means either on or off. One way to define the switching variable is let it be a sign function.

One embodiment of the invention is implemented as a program product for use with a computer system such as, for example, the schematics shown in FIG. 2 and described below. The program(s) of the program product defines functions of the embodiments (including the methods described below with reference to FIG. 3 and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA)or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A method of controlling a variable cam timing (VCT) system for an internal combustion engine including: a camshaft and a crankshaft; a camshaft sensor and a crankshaft sensor, each producing measurement pulses; and a variable cam timing phaser having: a housing having an outer circumference for accepting drive force; a rotor for connection to a camshaft coaxially located within the housing, the housing and the rotor defining at least one vane separating a plurality of chambers, the vane being capable of rotation to shift the relative angular position of the housing and the rotor; a spool valve comprising a slidable spool for controlling fluid flow between the plurality of chambers; and an on/off solenoid for controlling the position of the spool, the method comprising the steps of:

determining a measured angular phase between the camshaft and the crankshaft using measurement pulses;

determining a switch value equal to the difference between a set point and the measured angular phase; and controlling the on/off solenoid based on the switch value, wherein if the switch value is greater than zero, the on/off solenoid is turned on, allowing fluid to flow in a first direction between the plurality of chambers and if the switch value is less than zero, the on/off solenoid is turned off, allowing fluid to flow in a second direction, opposite the first direction between the plurality of chambers.

2. The method of claim 1, wherein the switch value is calculated according to equation:

$$\text{switch}=C_1*(\text{the setpoint}-\text{the sensed signal})+C_2*(\text{the rate of change of the sensed signal})$$

wherein $C_1$, and $C_2$ are control parameters subject to tuning.

3. The method of claim 1, wherein if the switch value is equal to zero, status of the on/off solenoid is maintained.

4. A variable cam timing(VCT) system for an internal combustion engine comprising:

a camshaft and a crankshaft;

a camshaft sensor and a crankshaft sensor each producing measurement pulses; and a variable cam timing phaser comprising:

a housing having an outer circumference for accepting drive force;

a rotor for connecting to a camshaft coaxially located within the housing, the housing and the rotor defining at least one vane separating a plurality of chambers the vane being capable of rotation to shift the relative angular position of the housing and the rotor;

a spool valve comprising a slidable spool for controlling fluid flow between the plurality of chambers;

an on/off solenoid for controlling the position of the spool; and a control system for controlling positions of the on/off solenoid operated be a method comprising the steps of:

determining a measured angular phase between the camshaft and the crankshaft using the measurement pulses;

determining a switch value equal to a difference between a set point and the measured angular phase; and controlling the on/off solenoid based on the switch value, wherein if the switch value is greater than zero, the on/off solenoid is turned on, allowing fluid to flow in a first direction between the plurality of chambers and if the switch value is less than zero, the on/off solenoid is turned off, allowing fluid to flow in a second direction, opposite the first direction between the plurality of chambers.

5. The system of claim 4, wherein the switch value is calculated according to equation:

$$\text{switch}=C_1*(\text{the setpoint}-\text{the sensed signal})+C_2*(\text{the rate of change of the sensed signal})$$

wherein $C_1$, and $C_2$ are control parameters subject to tuning.

6. The method of claim 4, wherein if the switch value is equal to zero, status of the on/off solenoid is maintained.

* * * * *